US008256946B2

(12) United States Patent
Ohno et al.

(10) Patent No.: US 8,256,946 B2
(45) Date of Patent: Sep. 4, 2012

(54) VEHICLE LIGHT

(75) Inventors: Masafumi Ohno, Tokyo (JP); Ryotaro Owada, Tokyo (JP); Norikatsu Myojin, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 306 days.

(21) Appl. No.: 12/820,117

(22) Filed: Jun. 21, 2010

(65) Prior Publication Data

US 2010/0321948 A1 Dec. 23, 2010

(30) Foreign Application Priority Data

Jun. 19, 2009 (JP) ..... 2009-146742

(51) Int. Cl.
*F21V 7/00* (2006.01)
*F21V 5/04* (2006.01)

(52) U.S. Cl. ..... 362/555; 362/507; 362/511; 362/310

(58) Field of Classification Search ..... 362/555, 362/511, 307, 308, 310, 507, 311.02
See application file for complete search history.

(56) References Cited

U.S. PATENT DOCUMENTS 7,070,312 B2 7/2006 Tatsukawa
7,631,997 B2 * 12/2009 Ishida et al. ..... 362/520
7,815,345 B2 * 10/2010 Misawa et al. ..... 362/327
7,828,448 B2 * 11/2010 Kim et al. ..... 353/99
8,011,803 B2 * 9/2011 Cheung et al. ..... 362/244
8,075,166 B2 * 12/2011 Ohno et al. ..... 362/310

FOREIGN PATENT DOCUMENTS

JP 2005-11704 A 1/2005

* cited by examiner

*Primary Examiner* — Peggy A. Neils
(74) *Attorney, Agent, or Firm* — Kenealy Vaidya LLP

(57) ABSTRACT

A vehicle light can prevent the generation of glare light due to the reflection of light from a connecting surface surrounding a reflecting surface when a lens body including the reflecting surface and the connecting surface surrounding the reflecting surface is used and light emitted from an LED light source enters the lens body. The vehicle light can include a light source and a lens body. The lens body can include optical surfaces including the reflecting surface configured to form a predetermined light distribution pattern, and connecting surfaces that shape and define a structure of the lens body by connecting the optical surfaces, but that do not engage in the formation of the light distribution pattern. The connecting surface surrounding the reflecting surface can reflect part of incident light from the light source to a direction that is different from the direction by the reflecting surface and is directed to any one of connecting surfaces. One of the connecting surfaces can receive the light reflected by the connecting surface and project the light therethrough.

20 Claims, 5 Drawing Sheets

VEHICLE LIGHT

This application claims the priority benefit under 35 U.S.C. §119 of Japanese Patent Application No. 2009-146742 filed on Jun. 19, 2009, which is hereby incorporated in its entirety by reference.

TECHNICAL FIELD

The presently disclosed subject matter relates to a vehicle light, and in particular, to a vehicle light utilizing a lens body having optical surfaces, including an incident surface, a reflecting surface, and a projecting surface, configured to form a predetermined light distribution pattern, and connecting surfaces which shape and define the structure of the lens body by connecting the optical surfaces, but which do not engage in the formation of the light distribution pattern).

BACKGROUND ART

One conventional vehicle light 400 is illustrated as a conceptual diagram in FIG. 1. This type of vehicle light 400 can be configured to include a lens body 410 having a recess, and a light source (such as an LED light source) 420 disposed within the recess of the lens body 410. The lens body 410 can include optical surfaces (including an incident surface 414*a*, a reflecting surface 412*a*, and a projecting surface 411*a*) that are configured to form a predetermined light distribution pattern, and connecting surfaces 416 and the like which shape and define the structure of the lens body by connecting the optical surfaces, but which do not engage in the formation of the light distribution pattern). In the vehicle light 400, the lens body 410 can include a recess and the LED light source 420 can be disposed within the recess so that the light emitted by the LED light source 420 can be guided toward the lens body and reflected to form a predetermined light distribution pattern (see for example, Japanese Patent Application Laid-Open No. 2005-11704).

Another exemplary vehicle light 500 is illustrated in FIG. 2, which has a similar configuration to the conventional vehicle light shown in FIG. 1. FIG. 1 shows that the vehicle light 500 includes a lens body 510 having optical surfaces, including an incident surface 514*a*, a reflecting surface 512*a*, and a projecting surface 511*a*, and connecting surfaces having surfaces 516, 512*b* and the like, and an LED light source 520. In particular, in the vehicle light 500 of FIG. 2, the lens body 510 includes the reflecting surface 512*a* and the connecting surface 512*b* surrounding the reflecting surface 512*a* on the same plane (on the same side surface). In this configuration, the light emitted from the LED light source 520 and entering the incident surface 514*a* of the lens body 510 may partly enter the connecting surface 512*b* that is disposed so as to surround the reflecting surface 512*a* on the same plane. In this case, the light can be reflected by the connecting surface 512*b*, so that the light may exit the lens body 510 through the projecting surface 511*a*. Since the connecting surface 512*a* intrinsically does not engage in the formation of the light distribution pattern, the light reflected by the connecting surface 512*a* may become glare light.

A projector headlight is also disclosed in Applicant's patent application, U.S. patent application Ser. No. 12/820,120, filed on same date, Jun. 21, 2010, which is hereby incorporated in its entirety by reference.

SUMMARY

The presently disclosed subject matter was devised in view of these and other problems and features and in association with the conventional art. According to an aspect of the presently disclosed subject matter, a light (or a vehicle light) can prevent the generation of glare light due to the reflection of light from a connecting surface surrounding a reflecting surface when a lens body including the reflecting surface and the connecting surface surrounding the reflecting surface is used and light emitted from an LED light source enters the lens body.

According to another aspect of the presently disclosed subject matter, a light can include a light source and a lens body. The lens body can include, among its surfaces, optical surfaces including an incident surface, a reflecting surface, and a projecting surface which are configured to form a predetermined light distribution pattern; and connecting surfaces which shape and define a structure of the lens body by connecting the optical surfaces, but which do not engage in the formation of the light distribution pattern. The incident surface can be configured to include a lens surface that can receive light from the light source to allow the light to enter the lens body. The reflecting surface can be configured to reflect the light from the light source toward the projecting surface so as to form the light distribution pattern. The projecting surface can be configured to include a lens surface that can receive the light directly from the light source and the light reflected by the reflecting surface and project the same. The connecting surfaces can include an adjacent connecting surface surrounding the reflecting surface. Part of incident light from the light source can reach the adjacent connecting surface and be reflected by the same to a direction that is different from the projection surface direction by the reflecting surface and is directed to any one of the connecting surfaces. One of the connecting surfaces can receive the light reflected by the adjacent connecting surface and project light therethrough.

A light having the above configuration can have an adjacent connecting surface surrounding the reflecting surface which can reflect light in a different direction from the reflecting surface adjacent thereto, the different direction being the direction toward any other one of the connecting surfaces. The other one of the connecting surfaces can allow the light to pass therethrough to project light therefrom. Accordingly, light emitted from the LED light source entering the lens body can be prevented from becoming glare light by being reflected by the connecting surface surrounding the reflecting surface.

In the above-mentioned configuration, the light source can be an LED light source. If an LED which generates less heat is used as the light source, even when the lens body is made of a resin and the light source is disposed nearby the resin-made lens body, the lens body cannot be affected by heat generated by the light source, thereby preventing the lens body from being deformed and ensuring maintenance of the dimension of the lens body.

Accordingly, the lens body can be molded by injection molding a transparent resin as a unit. This resin-made lens body can be used together with the LED light source with less heat generation, thereby providing an inexpensive lens body with high accuracy.

In the above-mentioned configuration, the lens body can have a substantial cubic shape including a bottom surface, side surfaces, a front surface, a rear surface and a top surface. In this case, the incident surface can be arranged in the bottom surface, the projecting surface can be arranged in the front surface, and the reflecting surface can be arranged in the rear surface. In this configuration, the adjacent connecting surface surrounding the reflecting surface can reflect the light to any connecting surface along the side surfaces and the bottom surface, and the receiving connecting surface along the side surface or the bottom surface can allow the light to pass therethrough to be projected to the outside. Accordingly, light reflected by the adjacent connecting surface can exit through the side surfaces or the bottom surface, resulting in the elimination of adverse affects on the light distribution pattern. In addition, the reflected light cannot be directed to the light projection direction through the projecting surface, thereby preventing the light from becoming glare light.

A light made in accordance with the principles of the presently disclosed subject matter can be a vehicle light for use as a vehicle headlight, a vehicle signal light, a vehicle fog light, and the like.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to lights, and more particularly to vehicle lights, of the presently disclosed subject matter with reference to the accompanying drawings in accordance with exemplary embodiments.

Figure 1:
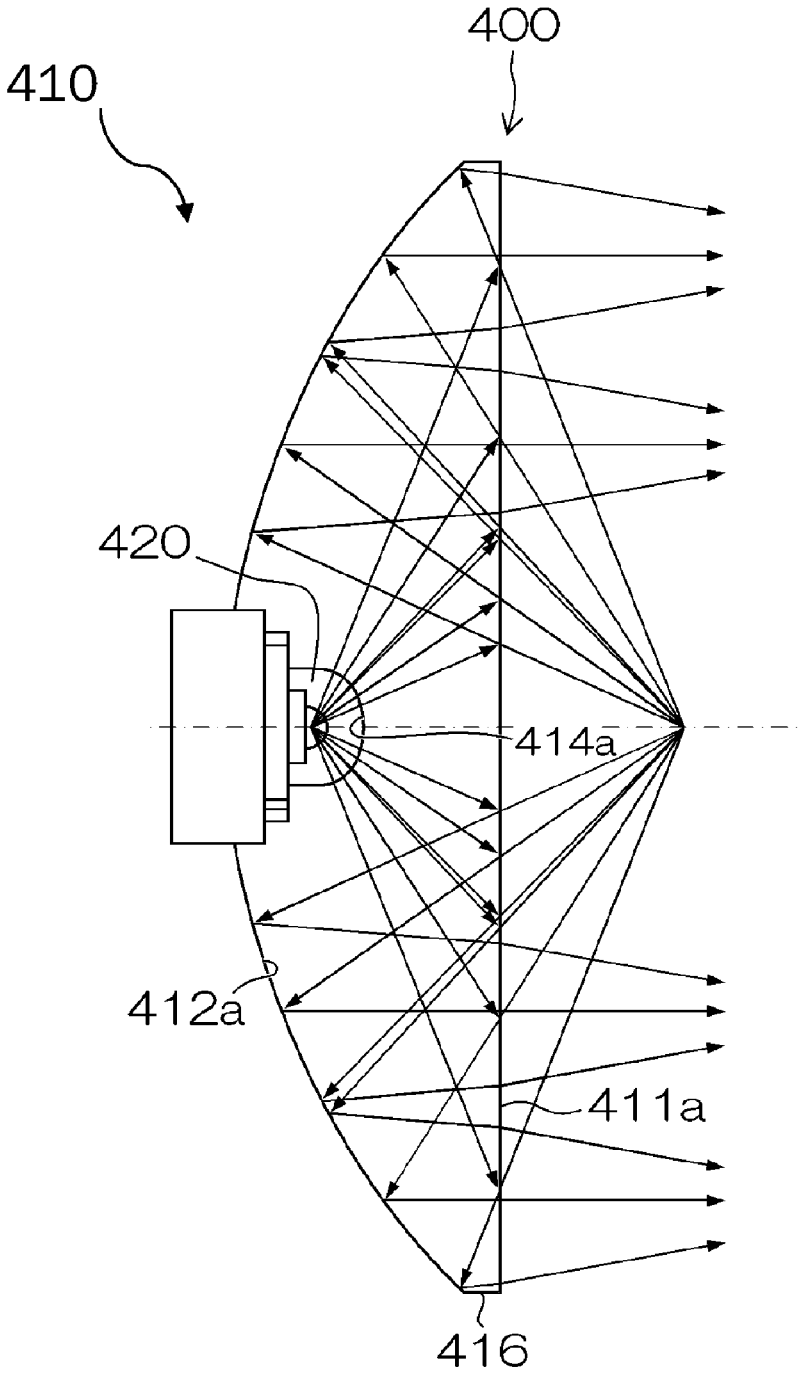
Fig. 1 Conventional Art
FIG. 1 is a conceptual diagram illustrating a conventional vehicle light.
Figure 2:
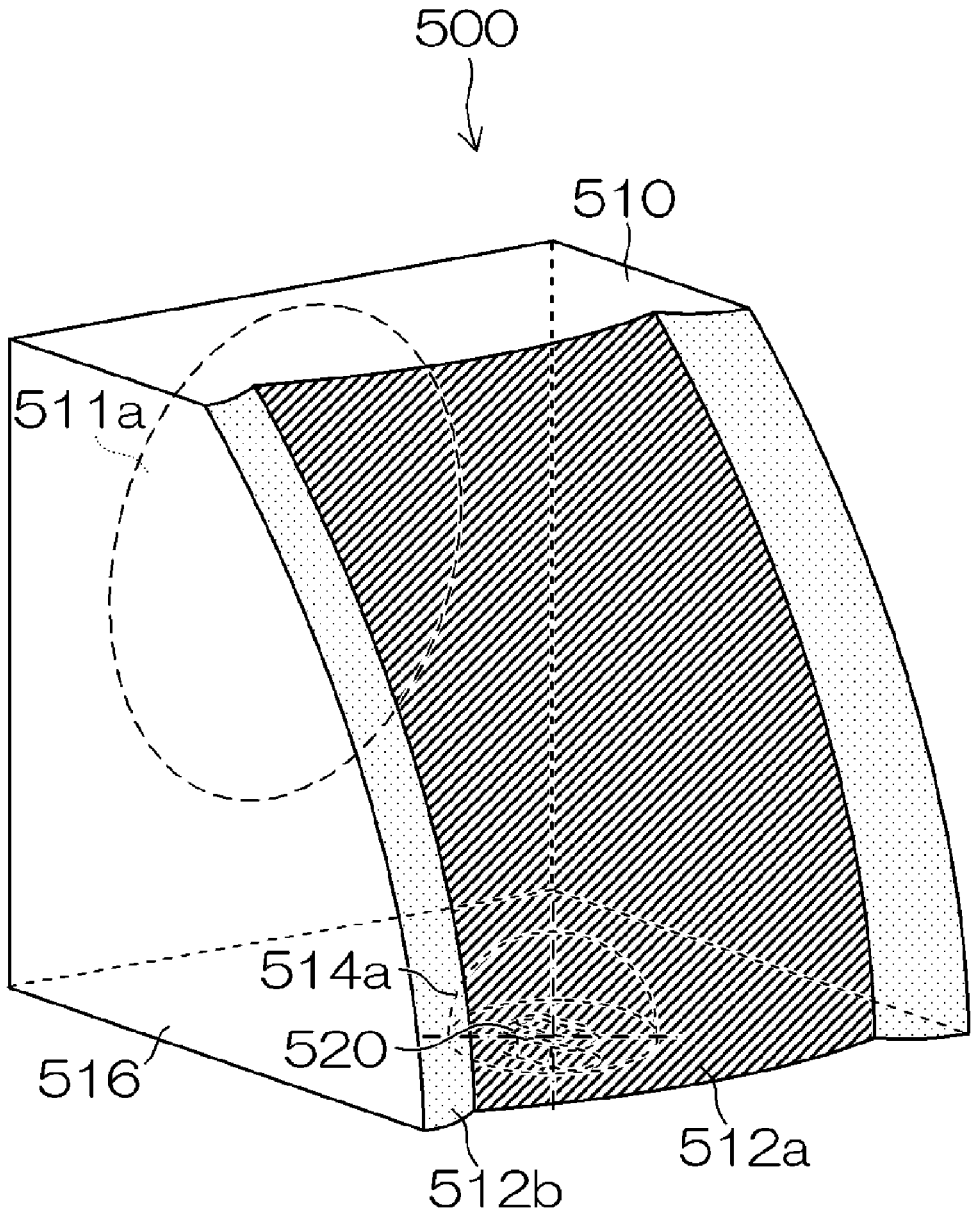
Fig. 2 Conventional Art
FIG. 2 is a perspective view illustrating another conventional vehicle light including a lens body having an adjacent connecting surface surrounding a reflecting surface.
Figure 3:
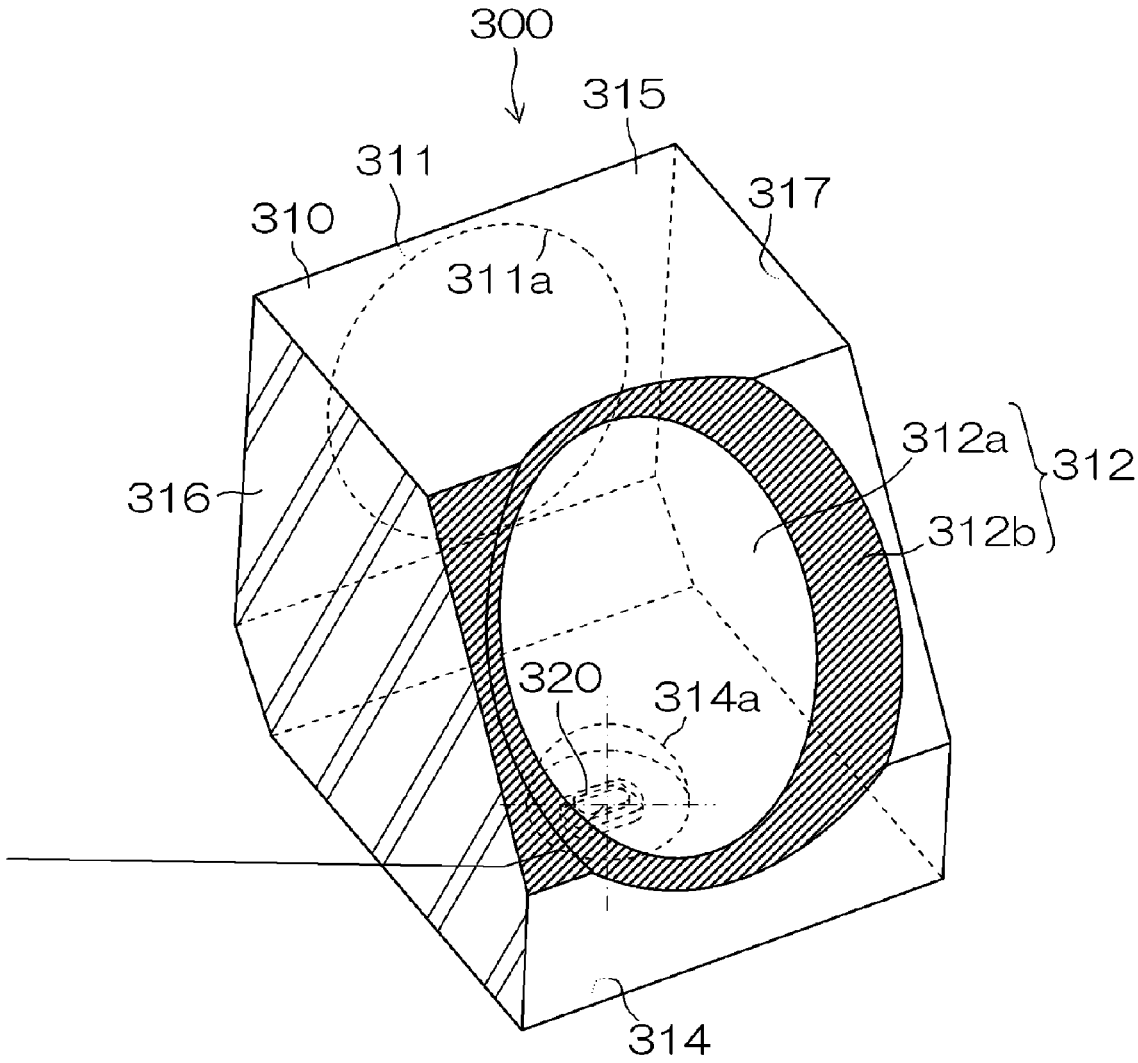
FIG. 3 is a perspective view illustrating a light according to one exemplary embodiment made in accordance with principles of the presently disclosed subject matter.

A vehicle light 300 of the exemplary embodiment as shown in FIG. 3 can be utilized as a vehicle headlight (for example, a headlamp, a signal lamp and the like for use in automobiles, motorcycles and the like). As shown in FIG. 3, the vehicle light 300 of FIG. 3 can include a lens body 310 made of a transparent resin, a light source 320, and the like.

The lens body 310 can be molded by injection molding a transparent resin such as acrylic resin, polycarbonate resin or the like into a solid lens body. FIG. 3 is a perspective view when the lens body 310 is viewed from its rear, left upper side while the light projection side is defined as a front surface. The lens body 310 can include a front surface 311 that is positioned in the front side of a vehicle body and can include a projecting surface 311*a*, a rear surface 312 that is positioned in the rear side and can include a reflecting surface 312*a* and an adjacent connecting surface 312*b* which does not engage in the formation of a light distribution pattern, a bottom surface 314 that includes an incident surface 314*a*, an upper surface 315, and side surfaces 316 and 317. These surfaces can define the lens body having a substantially cubic shape. Herein, the projecting surface 311*a*, the reflecting surface 312*a* and the incident surface 314*a* can serve as optical surfaces, and the surfaces other than these optical surfaces can serve as connecting surfaces which may define the shape of the lens body but do not engage in the formation of the light distribution pattern.

The incident surface 314*a* can be a lens surface that can allow the light emitted from the light source 320 to enter the lens body 310, and can be formed in the bottom surface 314.

The reflecting surface 312*a* can be configured to reflect the incident light from the light source 320 in the direction toward the projecting surface so as to form a predetermined light distribution pattern, and can be a revolved parabolic reflecting surface. The reflecting surface 312*a* can be formed by forming a convex portion at a designed portion of the lens body (by integral molding or bonding a separate member) and then depositing metal such as A1 thereon.

The projecting surface 311*a* can be a lens surface configured to project light directly from the light source 320 and/or the light reflected from the reflecting surface 312*a*, and can be formed in the front surface 311 of the lens body 310. The projecting surface 311*a* can be covered with an anti-reflection film, if necessary.

The light source 320 can be composed of one or a plurality of LED chips in a packaged form. The light source 320 can be fixed to the lens body 310 by utilizing, for example, a sealant such as a transparent resin so that the light emitted therefrom can be incident on the incident surface 314*a* of the lens body 310. Since an LED is utilized as the light source 320, the adverse effect of heat on the resin-made lens body 310 can be reduced.

The connecting surface 312*b*, which corresponds to an example of an adjacent connecting surface surrounding the reflecting surface, can be configured to shape and define the structure of the lens body 310, but does not engage in the formation of the light distribution pattern. Here, the connecting surface 312*b* can be formed in the rear surface 312 to surround the reflecting surface 312*a*.

Figure 4:
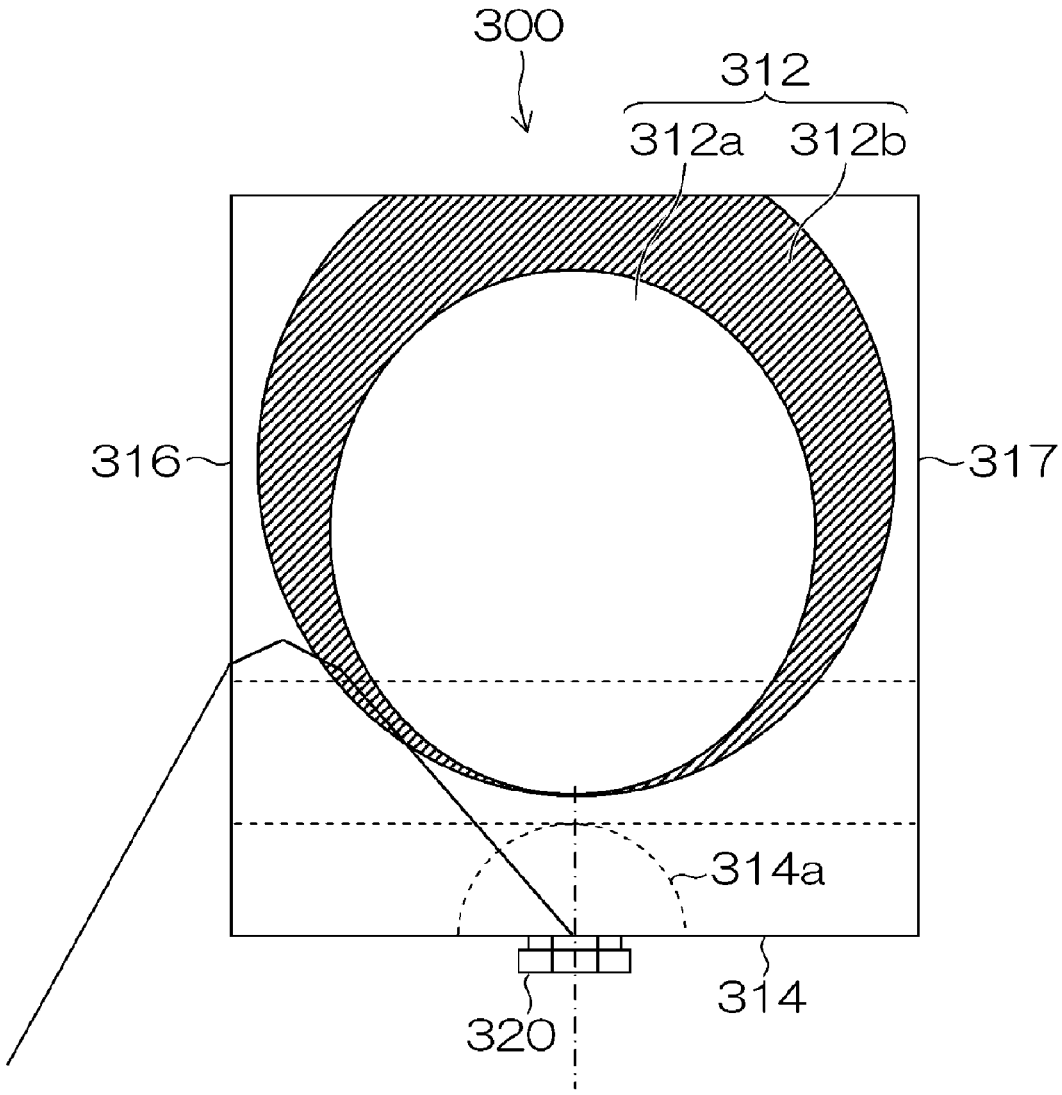
FIG. 4 is a rear side view illustrating the light of FIG. 3.
Figure 5:
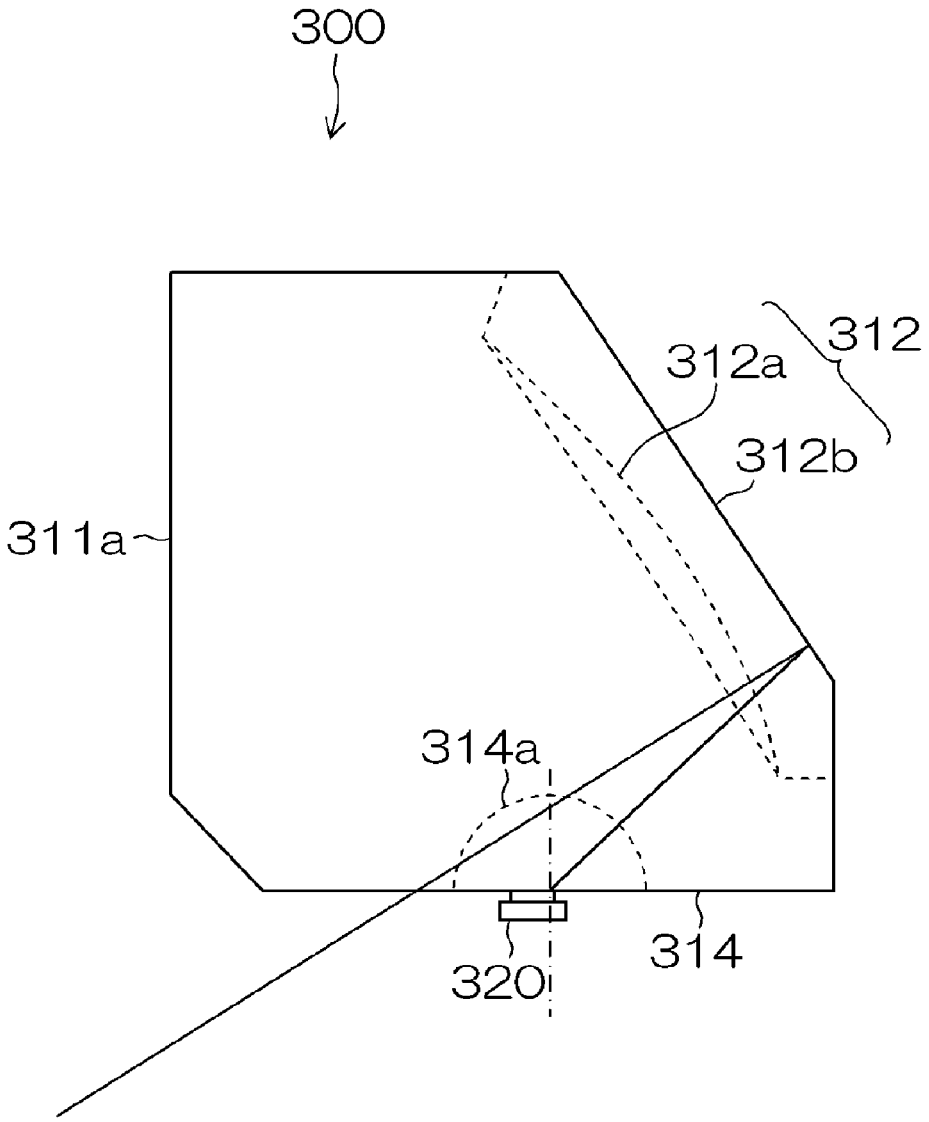
FIG. 5 is a side view illustrating the light of FIG. 3.

In the vehicle light 300 configured as described above, the light emitted from the LED light source 320 entering the incident surface 314*a* of the lens body 310 can partly enter the connecting surface 312*b* that does not engage in the formation of the light distribution pattern. In this case, the vehicle light 300 can be configured such that the connecting surface 312*b* can reflect the light not to the projecting surface 311*a*, but to other connecting surface. For example, as shown in FIGS. 3 and 4, the light reflected by the connecting surface 312*b* can be projected through the connecting surface 316 or the side surface. In another example, FIG. 5 illustrates another light path by another incident light, wherein the light reflected by the connecting surface 312*b* can be projected through the connecting surface 314 or the bottom surface. Namely, the connecting surface 312*b* which is disposed to surround the reflecting surface 312*a* can be configured to reflect the light from the LED light source 320 not in the direction toward the projecting surface 311*a*, but in the direction toward any other connecting surface. Part of the light emitted by the LED light source 320 and entering the lens body 310 can be reflected by the connecting surface 312*b*, thereby preventing the light from becoming glare light through the projection surface 311*a*.

Accordingly, the adjacent connecting surface 312*b* can reflect the light from the LED light source 320 not in the direction of reflection (toward the projecting surface 311*a*) by the reflecting surface 312*a*, but in the direction of any other connecting surface (for example, any one of the connecting side surfaces 316 and 317 and the bottom connecting surface 314). Part of the light emitted by the LED light source 320 and entering the lens body 310 can be reflected by the connecting surface 312*b*, thereby preventing the light from becoming glare light through the projection surface 311*a*.

Next, a modified example will be described.

In the above exemplary embodiment, the vehicle light 300 is configured such that the predetermined light distribution pattern can be formed by reflecting the light within the lens body 310 once. The presently disclosed subject matter is not limited to this embodiment. For example, the lens body can include a plurality of reflecting surfaces thereinside so that the light entering the lens body can be reflected two or more times by these reflecting surfaces for forming a required light distribution pattern.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A light comprising:

a light source; and a lens body, having a plurality of surfaces, including optical surfaces including an incident surface, a reflecting surface, and a projecting surface that are configured to form a predetermined light distribution pattern, the incident surface including a lens surface configured to receive light from the light source to allow the light to enter the lens body, the reflecting surface configured to reflect the light from the light source toward the projecting surface so as to form the light distribution pattern, the projecting surface including a lens surface configured to receive the light directly from the light source and the light reflected by the reflecting surface and to project the light; and connecting surfaces that shape and define a structure of the lens body by connecting the optical surfaces, but which do not engage in the formation of the light distribution pattern, the connecting surfaces including an adjacent connecting surface surrounding the reflecting surface, so that at least a part of incident light from the light source that reaches the adjacent connecting surface is reflected by the adjacent connecting surface in a direction that is different from a projection surface direction by the reflecting surface and is directed to any one of the connecting surfaces, wherein the one of the connecting surfaces which receives the light reflected by the adjacent connecting surface projects the light therethrough.

2. The light according to claim 1, wherein the light source is an LED light source.

3. The light according to claim 1, wherein the lens body is molded by injection molding a transparent resin and the lens body is configured as a unitary structure.

4. The light according to claim 2, wherein the lens body is molded by injection molding a transparent resin and the lens body is configured as a unitary structure.

5. The light according to claim 1, wherein:

the lens body has a substantial cubic shape including a bottom surface, side surfaces, a front surface, a rear surface and a top surface;

the incident surface is arranged in the bottom surface;

the projecting surface is arranged in the front surface;

the reflecting surface is arranged in the rear surface;

the adjacent connecting surface surrounding the reflecting surface is configured to reflect the light to a receiving connecting surface of the connecting surfaces in the side surfaces and the bottom surface, and the receiving connecting surface allows the light to pass therethrough to be projected to the outside.

6. The light according to claim 2, wherein:

the lens body has a substantial cubic shape including a bottom surface, side surfaces, a front surface, a rear surface and a top surface;

the incident surface is arranged in the bottom surface;

the projecting surface is arranged in the front surface;

the reflecting surface is arranged in the rear surface;

the adjacent connecting surface surrounding the reflecting surface is configured to reflect the light to a receiving connecting surface of the connecting surfaces in the side surfaces and the bottom surface, and the receiving connecting surface allows the light to pass therethrough to be projected to the outside.

7. The light according to claim 3, wherein:

the lens body has a substantial cubic shape including a bottom surface, side surfaces, a front surface, a rear surface and a top surface;

the incident surface is arranged in the bottom surface;

the projecting surface is arranged in the front surface;

the reflecting surface is arranged in the rear surface;

the adjacent connecting surface surrounding the reflecting surface is configured to reflect the light to a receiving connecting surface of the connecting surfaces in the side surfaces and the bottom surface, and the receiving connecting surface allows the light to pass therethrough to be projected to the outside.

8. The light according to claim 4, wherein:

the lens body has a substantial cubic shape including a bottom surface, side surfaces, a front surface, a rear surface and a top surface;

the incident surface is arranged in the bottom surface;

the projecting surface is arranged in the front surface;

the reflecting surface is arranged in the rear surface;

the adjacent connecting surface surrounding the reflecting surface is configured to reflect the light to a receiving connecting surface of the connecting surfaces in the side surfaces and the bottom surface, and the receiving connecting surface allows the light to pass therethrough to be projected to the outside.

9. The light according to claim 1, wherein the light is a vehicle light.

10. The light according to claim 2, wherein the light is a vehicle light.

11. The light according to claim 3, wherein the light is a vehicle light.

12. The light according to claim 4, wherein the light is a vehicle light.

13. The light according to claim 5, wherein the light is a vehicle light.

14. The light according to claim 6, wherein the light is a vehicle light.

15. The light according to claim 7, wherein the light is a vehicle light.

16. The light according to claim 8, wherein the light is a vehicle light.

17. A light, comprising:

a light source; and a lens body, the lens body including a plurality of optical surfaces configured to form a predetermined light distribution pattern, the plurality of optical surfaces including a first incident surface, a first reflecting surface and a first projection surface, the first incident surface including a lens surface configured to receive light from the light source and to pass the light received from the light source into the lens body, the first reflecting surface spaced away from the first incident surface, the first reflecting surface configured to reflect light from the light source toward the first projection surface to form the predetermined light distribution pattern, and the first projecting surface including a lens surface configured to receive light directly from the light source and from the first reflecting surface; and a plurality of connecting surfaces which define the structure of the lens body by connecting adjacent optical surfaces, the plurality of connecting surfaces configured so as not to contribute to the formation of the predetermined light distribution pattern, the connecting surfaces including a first connecting surface adjacent the first reflecting surface and configured so that at least a portion of the light received from the light source is reflected in a direction different from the direction of the projection surface and is directed to another of the connecting surfaces which projects the light therethrough.

18. The light according to claim 17, wherein the lens body consists of a single unitary transparent resin structure.

19. The light according to claim 17, wherein the light is configured as a vehicle light and the light source is an LED light.

20. The light according to claim 17, wherein the first connecting surface completely surrounds the first reflecting surface so as to space the first reflecting surface from the first incident surface.

* * * * *